United States Patent [19]

Stein

[11] 4,237,414

[45] Dec. 2, 1980

[54] HIGH IMPEDANCE OUTPUT CURRENT SOURCE

[75] Inventor: Marc T. Stein, Tempe, Ariz.

[73] Assignee: Motorola, Inc., Schaumburg, Ill.

[21] Appl. No.: 967,823

[22] Filed: Dec. 8, 1978

[51] Int. Cl.[3] ..... G05F 1/56

[52] U.S. Cl. ..... 323/4; 307/297; 330/257

[58] Field of Search ..... 323/1, 4, 9; 307/296 R, 307/297, 315; 330/288, 257

[56] References Cited

U.S. PATENT DOCUMENTS

| | | | |
|---|---|---|---|
| 3,735,240 | 5/1973 | Davis et al. | 323/4 |
| 3,843,933 | 10/1974 | Ahmed | 323/4 X |
| 3,952,257 | 4/1976 | Schade, Jr. | 323/4 X |
| 4,008,441 | 2/1977 | Schade, Jr. | 323/4 X |
| 4,045,694 | 8/1977 | Ahmed | 323/4 X |

*Primary Examiner*—William M. Shoop
*Assistant Examiner*—Peter S. Wong
*Attorney, Agent, or Firm*—Michael D. Bingham

[57] ABSTRACT

Circuit which is suitable to be manufactured in integrated circuit form for providing a constant source current at an output for driving a load. The circuit includes a reference current source for providing a reference current, and a PNP turn around circuit consisting of matched transistor devices. The output current from the circuit is provided at the collector electrode of a second one of the matched transistors. A third transistor is coupled between the second transistor and the output of the circuit in a cascode configuration to buffer the collector of the second transistor from variation in the voltage level appearing at the output of the circuit. Additionally, another transistor is coupled between the reference current source and the cascoded transistor forming therewith a Darlington amplifier which produces a high output impedance at the output of the circuit. A bias circuit is supplied between the turn around circuit and the reference current source to eliminate errors by providing the base current drive for the matched transistors of the turn around circuit and for establishing a reference potential between the base and collector electrodes of the second transistor of the turn around circuit such that the current supplied therefrom is independent to the magnitude of the voltage derived across the load to be connected to the circuitry.

2 Claims, 1 Drawing Figure

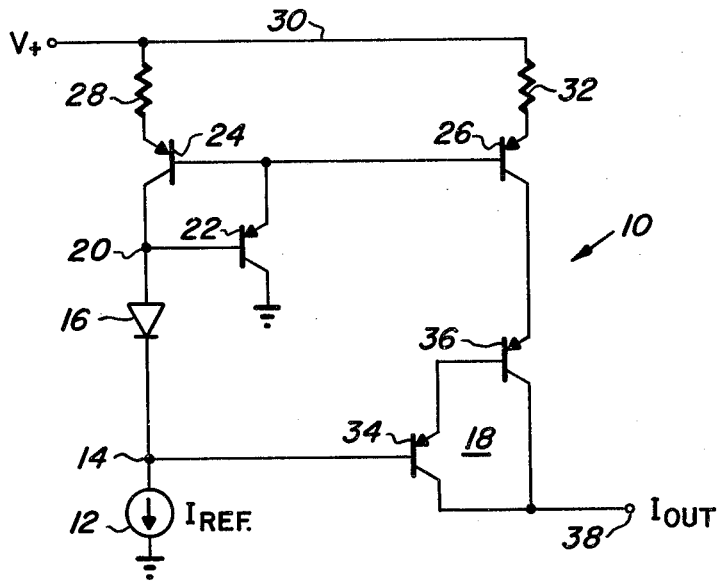
V+
30
28
32
24
26
22
20
10
16
36
34
18
14
12
IREF.
IOUT
38

HIGH IMPEDANCE OUTPUT CURRENT SOURCE

BACKGROUND OF THE INVENTION

This invention relates generally to circuitry for providing a constant output current and more particularly to circuitry for providing a constant source current at a high output impedance terminal.

When it is required to provide a constant source current to a load, such as, for example, a capacitor it is desired that the variation in voltage across the load as the capacitor is charged does not cause the constant current supplied thereto to be varied. If the magnitude of current supplied from the constant current source is caused to be varied, due to the change in magnitude of the voltage appearing across the capacitive load, the capacitor would not be charged at a linear rate. However, often it is desired that the charge rate of the capacitor be linear which would be negated if the current from the constant current source were allowed to vary as before mentioned.

SUMMARY OF THE INVENTION

Accordingly, it is an object of the present invention to provide new and improved circuitry which maintains a constant current output.

It is another object of the present invention to provide a new and improved constant current source having a high output impedance terminal at which a constant current may be sourced to a load.

It is still another object of the present invention to provide a constant current source suitable to be fabricated in integrated circuit form.

The constant current source of the present invention comprises a circuit for supplying a predetermined reference current, a PNP turn around circuit coupled to the reference current circuit and having an output node at which a substantially constant current is supplied that is equal in magnitude to the reference current. The PNP turn around circuit includes first and second matched PNP transistors and a self biasing network. The base electrodes of the first and second PNP transistors are interconnected together and the respective emitter electrodes coupled to a source of operating potential. The self biasing network comprises a PNP substrate transistor having the collector electrode connected to a ground reference potential and the emitter electrode connected to the interconnected base electrodes of the first and second PNP transistors. The base electrode of the foregoing transistor is connected to the collector electrode of the first PNP transistor. The self biasing network further includes a diode coupled between the collector of the first PNP transistor to the current reference circuit. The collector electrode of the second PNP transistor is coupled in a cascode configuration with a PNP Darlington amplifier circuit which provides the current at the output of the Darlington amplifier. The input to the Darlington amplifier circuit is connected to the reference current circuit. Because the two PNP transistors are ideally matched, the current pulled through the diode from the collector of the first PNP transistor is exactly mirrored to the output of the second PNP transistor and supplied to the Darlington amplifier. A self biasing voltage level is provided at the cathode electrode of the diode to the input of the Darlington amplifiers such that the collector electrode of the second PNP transistor is maintained at a voltage level nearly equal to the base electrode thereof. Therefore, the current supplied from this transistor remains substantially constant even though the voltage level appearing at the output of the Darlington amplifier may vary.

BRIEF DESCRIPTION OF THE DRAWING

The single FIGURE of the drawing is a schematic diagram of a preferred embodiment of the invention.

DESCRIPTION OF THE INVENTION

There is illustrated in the single Figure of the drawing a constant current source 10 of the present invention. It is noted that in the preferred embodiment constant current source 10 is fabricated in monolithic integrated form. Constant current source 10 includes reference current circuit 12 which is connected at a common junction 14 to the cathode electrode of diode 16 and to the input of PNP Darlington amplifier 18. The anode of diode 16 is connected at common junction 20 to the base of PNP transistor 22 and to the collector of PNP transistor 24 respectively. The collector of transistor 22 is connected to ground potential and the emitter thereof connected to the base of transistor 24. As will be explained later in detail, the particular combination of diode 16 and transistor 22 provide a self biasing circuit for setting the voltage level at terminal 14 at a predetermined voltage.

Transistor 24 and PNP transistor 26 form a PNP turn around circuit generally known in the art. The emitter of transistor 24 is coupled through resistor 28 to power supply conductor 30. The base of transistor 24 is also connected to the base of transistor 26. The emitter electrode of the latter device is coupled through resistor 32 to power supply conductor 30. Power supply 30 is adapted to be coupled to a source of operating potential V+. Darlington amplifier 18 comprises PNP transistors 34 and 36 with the base electrode (input terminal) of transistor 34 being connected to junction point 14. The common connected collectors of transistors 34 and 36 are adapted to be connected to an output of constant current source 10 to supply a source current thereat to a load which may be connected to terminal 38.

The emitter of transistor 36 of Darlington amplifier 18 is coupled to the collector electrode of transistor 26 in a cascode configuration. Hence, the collector current supplied from the collector electrode of transistor 26 is passed through amplifier 18 to output terminal 38 of constant current source 10.

Generally, all of the PNP transistor devices other than PNP transistor 22 are lateral PNP transistors. Transistor 22 is a PNP substrate transistor. Ideally, resistors 28 and 32 are of equal value and transistors 24 and 26 have matched characteristics.

In operation, the current $I_{REF}$ is drawn through the collector-emitter path of transistor 24 through diode 16. The current $I_{REF}$, through diode 16, causes the voltage at junction 20 to be such that the base to emitter junction of transistor 22 is forward biased to cause base current of this transistor to be pulled from the respective bases of transistors 24 and 26. Therefore, assuming initial starting conditions, the increasing current through diode 16 in turn increases the base current drive from transistor 22 until such time that the collector current of transistor 24 prevents any further increase in the base current from transistor 22. As transistors 24 and 26 are matched, in the foregoing condition, equal base currents will be drawn from these two devices by transistor 22 such that as transistor 24 conducts a collector current equal to $I_{REF}$ the collector current from transistor 26 will also be equal to collector current $I_{REF}$. Because transistor 22 provides the base current for transistors 24 and 26, the magnitude of the current supplied at the collector of transistor 26 is ensured to be substantially equal to the current $I_{REF}$.

The cascoded configuration of transistors 26 and 36 isolates the collector of transistor 26 from any voltage variations appearing on the collector of transistor 36. For instance, if it can be shown that transistor 26 is not allowed to saturate, by holding both the base and the collector electrodes at essentially the same voltage level, it can be proven that variation in the voltage level appearing at terminal 38 will not effect the magnitude of current supplied from transistor 26. As is seen, the voltage level at the base of transistors 24 and 26 are most nearly at a one $V_{BE}$ level (where $V_{BE}$ is the base to emitter voltage drop) below the power supply voltage V+. The self biasing circuit comprising transistor 22 and diode 16 can be shown to cause the voltage level at junction 14 to be two more $V_{BE}$ drops below the power supply voltage, or at a minus three $V_{BE}$ voltage level. It is then observed that the minus 3 $V_{BE}$ level at junction 14 is translated up through the base-emitter junctions of transistors 34 and 36 to a level approximately equal to a minus one $V_{BE}$ level at the collector of transistor 26. Thus, from above, it has been shown that both the base and collector electrodes of transistor 26 are most nearly at a minus one $V_{BE}$ voltage level with respect to V+. Hence, the current supplied from transistor 26 to Darlington amplifier 18 remains constant even through the voltage level appearing at terminal 38 may vary as for example when the output current, $I_{OUT}$ is utilized to charge a capacitive load linearly. In addition, Darlington amplifier 18 presents a high impedance output to terminal 38.

Thus, what has been shown is an improved current source having a high impedance output terminal at which is supplied a constant current, independent of the voltage level appearing at the output terminal.

We claim:

1. A current source for supplying current at a high impedance output to a load, comprising:

a current turn around circuit including first and second transistors each having an emitter, collector and base electrode, each of said emitter electrodes being coupled to a terminal at which is supplied a first potential level, said base electrodes being interconnected to each other;

a diode having an anode and cathode, said anode being coupled to said collector electrode of said first transistor;

means for supplying a reference current, said reference current means having an electrode connected to said cathode of said diode;

output means including first and second PNP transistors connected in a Darlington amplifier configuration with the base electrode of said first PNP transistor being connected to said cathode of said diode, the emitter of said second PNP transistor being connected to said collector electrode of said second transistor of said current turn around circuit, and the collectors of said first and second PNP transistors being interconnected with the output of the current source; and a third transistor having base, emitter and collector electrodes, said emitter electrode being connected to said base electrodes of said first and second transistors of said current turn around circuit, said collector electrode being connected to a terminal at which is supplied a second potential, and said base electrode being conected to said anode of said diode.

2. The current source of claim 1 wherein said first and second transistors of said current turn around circuit and said third transistor being PNP transistors.

* * * * *